US011969782B2

(12) United States Patent
Guastini et al.

(10) Patent No.: US 11,969,782 B2
(45) Date of Patent: Apr. 30, 2024

(54) METHOD FOR CONTAINING A SLAB DURING CONTINUOUS CASTING

(71) Applicant: ROTELEC SA, Saint-Quentin-Fallavier (FR)

(72) Inventors: Fabio Guastini, Parigi (FR); Thierry Gautreau, Ennery (FR); Jean-Yves Ren, Nogent sur Marne (FR); Giovanni Calvi, Le Perraux sur Marne (FR)

(73) Assignee: ROTELEC SA, Le Perraux sur Marne (FR)

( * ) Notice: Subject to any disclaimer, the term of this patent is extended or adjusted under 35 U.S.C. 154(b) by 0 days.

(21) Appl. No.: 17/256,001

(22) PCT Filed: Jun. 25, 2019

(86) PCT No.: PCT/EP2019/066798

§ 371 (c)(1),
(2) Date: Dec. 24, 2020

(87) PCT Pub. No.: WO2020/002313

PCT Pub. Date: Jan. 2, 2020

(65) Prior Publication Data

US 2021/0268573 A1 Sep. 2, 2021

(30) Foreign Application Priority Data

Jun. 25, 2018 (IT) ..... 102018000006635

(51) Int. Cl.

| | |
|---|---|
| ***B22D 11/128*** | (2006.01) |
| ***B22D 11/041*** | (2006.01) |
| ***B22D 11/12*** | (2006.01) |

(52) U.S. Cl.
CPC ..... *B22D 11/1287* (2013.01); *B22D 11/041* (2013.01); *B22D 11/122* (2013.01)

(58) Field of Classification Search
CPC .. B22D 11/115; B22D 11/122; B22D 11/1287
See application file for complete search history.

(56) References Cited

U.S. PATENT DOCUMENTS

2009/0183851 A1* 7/2009 Kunstreich ..... C08K 7/24 164/468
2015/0290703 A1 10/2015 Kunstreich

FOREIGN PATENT DOCUMENTS

CA 1 144 336 A 4/1983
DE 69 28 827 U 7/1970
(Continued)

OTHER PUBLICATIONS

International Search Report and Written Opinion for PCT/EP2019/066798, dated Jul. 11, 2019.

*Primary Examiner* — Kevin E Yoon
*Assistant Examiner* — Jacky Yuen
(74) *Attorney, Agent, or Firm* — MARSHALL, GERSTEIN & BORUN LLP

(57) ABSTRACT

A method for containing a slab during continuous casting, including casting a slab along a casting axis, said slab having a predefined width, wherein the method provides a containment of the slab with a plurality of rolls, said rolls being disposed in pairs facing to each other, and defining a passage along the casting axis for the cast slab, wherein the plurality of rolls includes electromagnetic rolls provided with an electromagnetic stirrer which stirs the liquid contained in the slab.

1 Claim, 3 Drawing Sheets

(56) References Cited

FOREIGN PATENT DOCUMENTS

| | | | | | |
|---|---|---|---|---|---|
| EP | 2 269 750 | A1 | | 1/2011 | |
| GB | 2038677 | A | * | 7/1980 | ..... B22D 11/122 |

* cited by examiner

METHOD FOR CONTAINING A SLAB DURING CONTINUOUS CASTING

FIELD OF THE INVENTION

The present invention concerns a method for containing a slab during continuous casting.

BACKGROUND OF THE INVENTION

Electromagnetic rolls have been using extensively in steel making industries since 1960's. In fact, electromagnetic rolls are used to keep stirred the liquid steel to increase internal soundness of the slabs.

At nowadays, people produce slabs with increasing thickness, which leads to a longer metallurgical length. This gives much lower potential position of using electromagnetic rolls under meniscus.

Meanwhile, the slabs are becoming wider and wider, with the need of higher productivity and larger variety of applications. The former two slab production trends arise a big challenge to the electromagnetic rolls themselves. In fact, the electromagnetic rolls must not suffer a too big mechanical deflection under the force of the ferrostatic pressure.

Normally, the steelmaking manufacturers only accept a very small mechanical deflection in order to guarantee a slab production free of defects. A high deflection of slabs leads to surface and internal cracks, but may also affect the stability of the steel liquid pool by bulging effect.

Such bulging behavior disturbs the steel meniscus and lead to powder entrapments, which is dramatic for the quality of steel grades. This effect appears even if the rolls are far away from meniscus.

Therefore it is essential that the electromagnetic rolls design keep, in such casting machines, the smallest mechanical deflection of the slabs, in no case bigger than the limit value set by the machine builder.

The theory of the beam tells us that the deflection is determined by the load conditions; this means what kind of load and where the load is distributed on the beam, as well as the electromagnetic rolls mechanical dimensions and properties.

The problem is how to mechanically design an electromagnetic roll capable of withstanding as much ferrostatic pressure with the smallest possible deflection while keeping in mind that the rolls diameter remains comparable to that of the neighboring rolls. In addition to these considerations, the electromagnetic performance must be kept high in order to bring metallurgical benefits to the slabs.

Usually, the load is symmetrically distributed over the slab. In a certain position, down in the casting machine, for a certain thickness and width of slabs, the ferrostatic pressure can be so high for a conventional one-piece roll that the deflection of rolls is too big to meet the needs of machine builders.

Indeed, in order to limit the roll deflection, three possible solutions are known and already used, but each has particular drawbacks.

The first known solution is to increase the diameter of the electromagnetic roll in order to increase the resisting area of the roll cross section. This is theoretically possible, but often impossible in practice because the diameter of the electromagnetic roll should remain compatible with the neighboring rolls and the pinch roll of the segment. As a consequence, this may have an impact on the bulging behavior and the crack rate of the slabs.

The second known solution is based on the length of the roll, because it plays a major role in the deflection. For slab widths greater than 2500 mm, it is possible to divide electromagnetic roll into two half-length of roll and keep under control the mechanical deflection while maintaining a high level of electromagnetic forces on the liquid steel.

This solution, based on split-electromagnetic roll, is described in the Patent US 2015/0290703 and has been used for several years in the industrial production. However, if the length of the roll becomes too short, namely the slab is shorter than 2500 mm, because of half-length of electromagnetic roll, the electromagnetic forces are not sufficient to effectively stir the liquid steel and improve internal soundness quality of slabs.

This occurs because the electromagnetic force is proportional to the electromagnetic roll pole pitch, which is related to the electromagnetic roll length. Thus the shorter electromagnetic roll length, the weaker the electromagnetic force.

The third known solution is an embodiment called backup roll. Instead of transforming the roll barrel into two barrels, one supporting roll is mounted in the middle of the electromagnetic roll, in order to support it. The idea is attractive but the practice of this simple solution on industrial production has shown major drawbacks.

In industrial production conditions, the tight and neat contact could not be ensured at all because the particles or bodies of different sizes, such as mill scales, are introduced between the electromagnetic roll and the backup roll. As a result, both the electromagnetic roll and the backup roll have signs of accelerated wear or are destroyed in many cases.

With this solution, the life time of the electromagnetic roll and backup roll are much reduced in leading to an over cost of maintenance. Consequently, this solution is not industrial reliable.

Known stirring process and device, that however do not solve the above problems, are described for example in the document CA-A-1144336. Other known continuous casting devices and methods are described for example in documents DE-U-6928827 and EP-A-2269750.

There is therefore a need to perfect a method and a device for containing a slab for a continuous casting machine, which can overcome at least one of the disadvantages of the state of the art.

One object of the present invention is to provide a method for containing a slab for a continuous casting machine which allows to limit the transverse deflection of the slab, even in containing zones where the slab is subjected to significant ferrostatic pressures, at the same time guaranteeing the necessary electromagnetic force able to maintain a high efficiency in stirring the liquid metal contained in the core or internal part of the slab.

It is a further object of the present invention to provide a method for containing a slab during continuous casting that allows to keep the diameter of electromagnetic rolls compatible with that of neighboring rolls, facilitating thereby its integration in the segment located downstream the casting equipment.

A further object of the present invention is to provide a method for containing a slab during continuous casting in which the electromagnetic stirring forces on the liquid steel are more homogeneous along the slab width, thus leading to better metallurgical results.

The Applicant has devised, tested and embodied the present invention to overcome the shortcomings of the state of the art and get the advantages explained below.

SUMMARY OF THE INVENTION

The present invention is set forth and characterized in the independent claims, while the dependent claims describe other characteristics of the invention or variants to the main inventive idea.

According to the above purposes, the present invention concerns a method for containing a slab during continuous casting, which provides to cast a slab along a casting axis. The slab has a predefined width.

The method further provides a containment of the slab with a plurality of rolls, said rolls being disposed in pairs facing to each other, and defining along the casting axis a passage for the cast slab.

The plurality of rolls comprises electromagnetic rolls provided with an electromagnetic stirrer, configured for stirring the liquid contained in the slab.

In use, the electromagnetic rolls have a length less than the width of the slab, so that the slab protrudes with respect to at least one end of said electromagnetic rolls, with at least one protruding portion.

By means of the containing method of the present invention, the transverse deflection of the slab is limited, even in containing zones where the slab is subjected to considerable ferrostatic pressures, and at the same time the necessary electromagnetic stirring force of the liquid metal contained in the core or the internal part of the slab is guaranteed.

The present invention keeps the deflection of the electromagnetic rolls within an acceptable value without using back-up rolls in wider slabs and/or when used in lower position where ferrostatic pressure is higher.

According to another embodiment, the slab is protruding, with respect to one end of the electromagnetic roll, by an unsupported width up to 300 mm, preferably up to 250 mm, and said protruding portion in not supported by rolls. In particular, the unsupported width of the slab is not in contact or supported by rolls, while the other part of the slab is fully contained by the electromagnetic roll.

According to one embodiment, each of the electromagnetic rolls is associated with a respective auxiliary containment roll, aligned to and in axis with the respective electromagnetic roll.

Embodiments of the present invention also relate to a casting equipment comprising a mold configured to cast a slab, and a plurality of rolls disposed in pairs facing to each other, and along the casting axis in order to define a passage for the cast slab. The plurality of rolls comprises electromagnetic rolls provided with an electromagnetic stirrer configured to stir the liquid contained in the slab. The electromagnetic rolls and therefore said passage have a length less than the width of the slab so that the slab protrudes with respect to one end of said electromagnetic rolls.

BRIEF DESCRIPTION OF THE DRAWINGS

These and other characteristics of the present invention will become apparent from the following description of some embodiments, given as a non-restrictive example with reference to the attached drawings wherein.

To facilitate comprehension, the same reference numbers have been used, where possible, to identify identical common elements in the drawings. It is understood that elements and characteristics of one embodiment can conveniently be incorporated into other embodiments without further clarifications.

DETAILED DESCRIPTION OF SOME EMBODIMENTS

Figure 8:
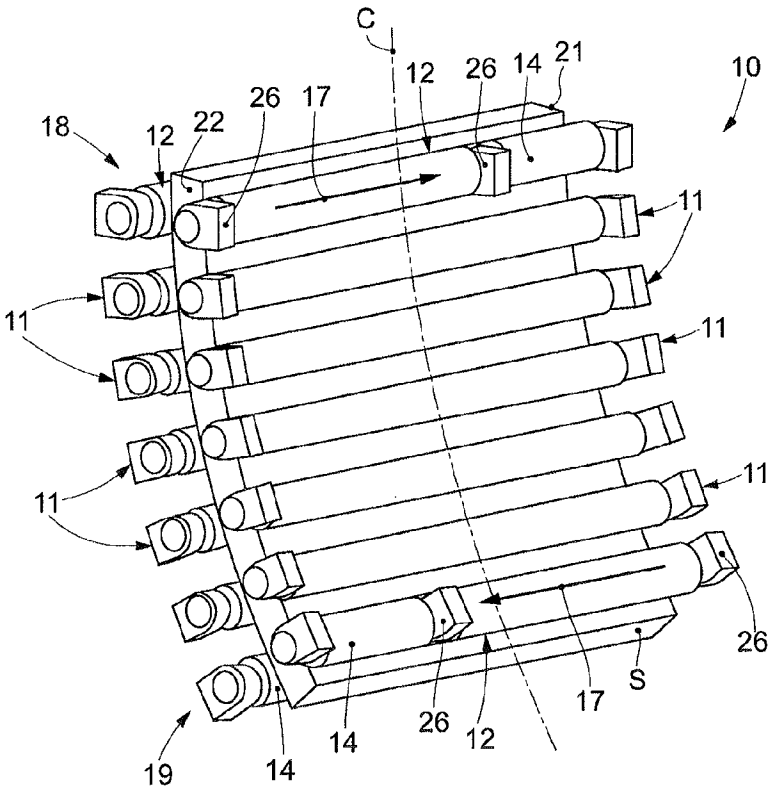
FIG. 8 is a prospective view of one embodiment of the present invention.
Figure 1:
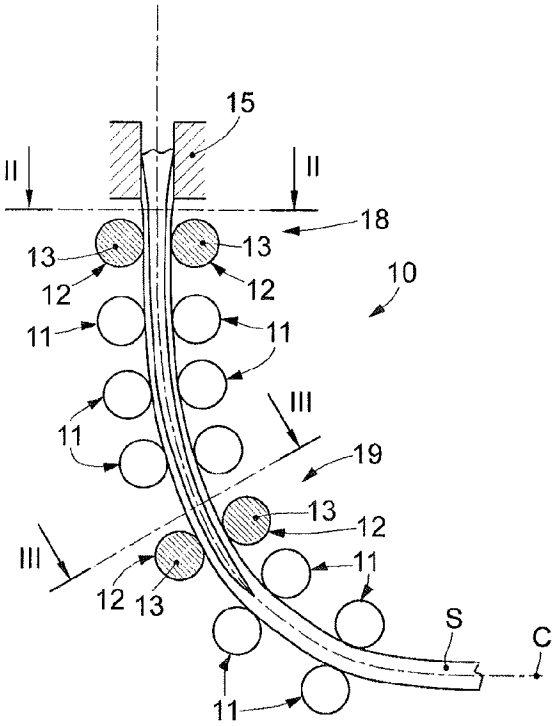
FIG. 1 is a schematic view of a continuous casting machine according to the present invention.

Reference will now be made in detail to the various embodiments of the invention, one or more examples of which are illustrated in the figures. Generally, only the differences with respect to individual embodiments are described. Each example is provided by way of explanation of the invention and is not meant as a limitation of the invention. For example, features illustrated or described as part of one embodiment can be used on or in conjunction with other embodiments to yield yet a further embodiment. It is intended that the present invention includes such modifications and variations.

Embodiments described here with reference to FIGS. 1-8 concern to a method for containing a slab during continuous casting.

The method provides to cast a slab S along a casting axis C of a casting equipment 10.

According to one embodiment of the present invention, the slab S is cast in a mold 15.

At the exit of the mold 15 the slab S has a solidified external skin and its inner portion, or core, which is still liquid.

The slab S has a predefined width W1. The width W1 of the slab S can be comprised between 1500 mm and 3000 mm, preferably between 1800 mm and 2500 mm.

The method provides a containment of the slab S with a plurality of rolls 11, 12.

The rolls 11, 12 are disposed in pairs facing to each other, and along the casting axis C.

The rolls 11, 12 define a passage for the cast slab S.

The rolls 11, 12 are free to rotate around respective axes of rotation that are perpendicular with respect to the casting axis C.

According to one embodiment, said plurality of rolls comprises containing rolls 11 configured to exert only a containing action on the slab S during continuous casting. The containing rolls 11 do not have the function of electromagnetic stirring, that is, they do not have a magnetic stirrer as described below.

The containing rolls 11 can be disposed faced, in pairs, to each other with respect to the casting axis C, or the slab S.

The containing rolls 11 can be of a length substantially equal to the width W1 of the cast slab S.

According to embodiments, not showed in the drawings, the containing rolls 11 can be composed by two, or more components. For example, the containing rolls 11 can be defined by two or more cylindrical bodies axially aligned with each other and supported at their respective ends by support elements. This solution allows to increase the resistance to flexion of the containing rolls 11, guaranteeing that the ferrostatic pressure of the slab S is contained.

Moreover, the plurality of rolls comprises a plurality of electromagnetic rolls 12.

According to an embodiment, the electromagnetic rolls 12 can be disposed faced, in pairs, to each other with respect to the casting axis C, or the slab S.

According to another embodiment, the electromagnetic rolls 12, or at least one of them, can be disposed faced to one of said containing rolls 11.

According to other embodiments of the present invention, the electromagnetic rolls 12 can be disposed only on one side with respect to the slab S.

The electromagnetic rolls 12 are disposed along the casting axis C faced to the liquid core of the slab S, in order to stir the liquid.

The electromagnetic rolls 12 are provided with an electromagnetic stirrer 13, which stirs the liquid contained in the slab S.

According to one solution, the electromagnetic stirrer 13 is contained inside the electromagnetic rolls 12.

In other embodiments (FIG. 1), the electromagnetic rolls 12 are also disposed in opposite pairs with respect to the slab S and along the casting axis C to exert, as well as the action of containing the slab S, also the action of stirring the liquid still present in the latter.

Each electromagnetic stirrer 13 can comprise at least one electromagnetic inductor disposed inside a respective electromagnetic roll 12. In particular, the electromagnetic stirrers 13 generate magnetic fields, and respective electromagnetic forces 17.

The electromagnetic forces 17 generate a plurality of recirculation loops 16 inside the liquid contained in the slab S, namely inside the skin.

According to possible embodiments, the electromagnetic rolls 12 have a length L above 1400 mm, and preferably below 2500 mm.

The electromagnetic rolls 12 are supported at their ends with respective support elements 26 conformed so as not to interfere with the surface of the slab S.

During casting, the electromagnetic rolls 12 have a length L lower than the width W1 of the slab S so that the slab S protrudes with respect to one end of said electromagnetic rolls 12.

Therefore, during casting the slab S has a protruding portion 20, which is not in contact with the electromagnetic rolls 12.

Moreover, the protruding portion 20 protrudes, with respect to the electromagnetic rolls 12, in a direction parallel to the rotation axis of the latters.

In particular, it is provided that the electromagnetic rolls 12 have a containing surface, configured to contain during use the slab S which is cast, and which has said length L. The slab S therefore protrudes with respect to a lateral edge of said containing surface of the electromagnetic rolls 12.

The containing surface is the one which, during use, is in direct contact with the slab S which is cast. The protruding portion 20 is therefore not in contact with the containing surface. The containing surface has a cylindrical shape.

In this way, despite having the protruding portion 20, the slab S is supported in a stable manner, preventing excessive flexions and guaranteeing the necessary electromagnetic force of the electromagnetic stirrer 13.

According to one embodiment (FIGS. 2-4), the slab S is protruding, with respect to one end of the electromagnetic roll 12, by an unsupported width W2 up to 300 mm, preferably up to 250 mm.

Therefore only a small portion of the slab S is not supported by the electromagnetic rolls 12. The steel in the edge of the slab S is almost completely solidified at this location down the casting machine and this unsupported zone is not a drawback for the quality issue.

According to another embodiment of the invention the ratio between the unsupported width W2 of the slab S which protrudes externally, that is, laterally to the electromagnetic rolls 12, and the width W1 of the slab S is comprised between 2% and 20%, preferably between 2.5% and 16%.

According to one embodiment of the present invention (FIGS. 4, 7 and 8), said electromagnetic rolls comprise a first electromagnetic roll 12 and at least a second electromagnetic roll 12, distanced to each other along the casting axis C.

While in the following reference is made to a first and second electromagnetic rolls, it is not excluded that the same teachings can be applied for more than two electromagnetic rolls.

According to embodiments, the first electromagnetic roll 12 can be faced to another first electromagnetic roll 12 in order to define a first pair 18 of electromagnetic rolls 12.

According to further embodiments, the second electromagnetic roll 12 can be faced to another second electromagnetic roll 12 in order to define a second pair 19 of electromagnetic rolls 12.

Between the first electromagnetic roll 12 and the second electromagnetic roll 12, a plurality of said containing rolls 11 can be provided in order to contain and support the slab S.

According to an embodiment, the first electromagnetic roll 12 and the second electromagnetic roll 12 are disposed so that a first edge 21 of the slab S protrudes with respect to the first electromagnetic roll 12, while a second edge 22, opposite with respect to the first edge 21, protrudes with respect to the second electromagnetic roll 12.

Figure 4:
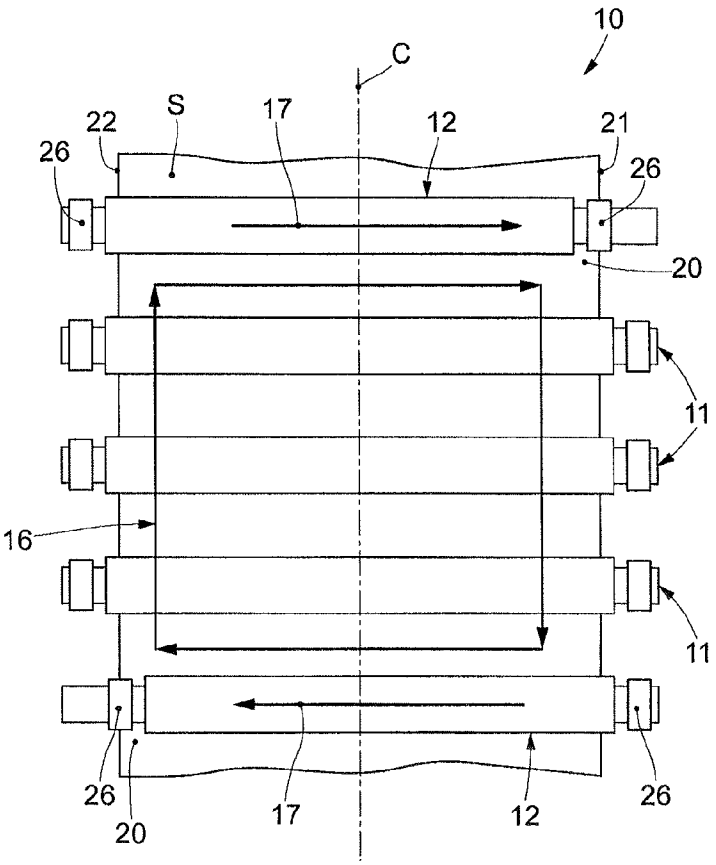
FIG. 4 is a lateral view of the FIG. 1.
Figure 2:
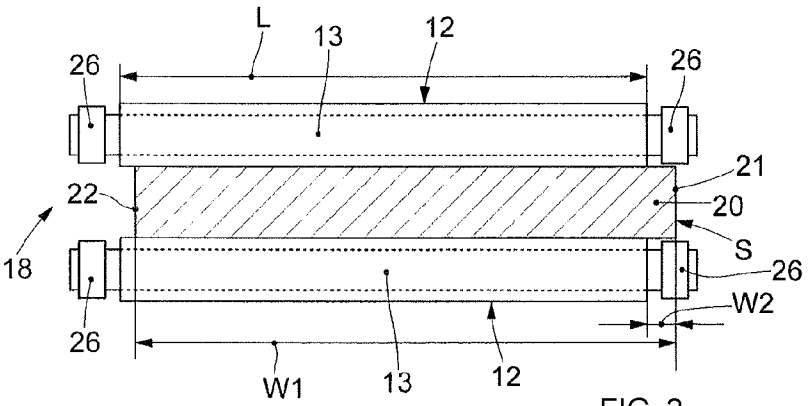
FIG. 2 is a section view along section line II-II of FIG. 1.
Figure 3:
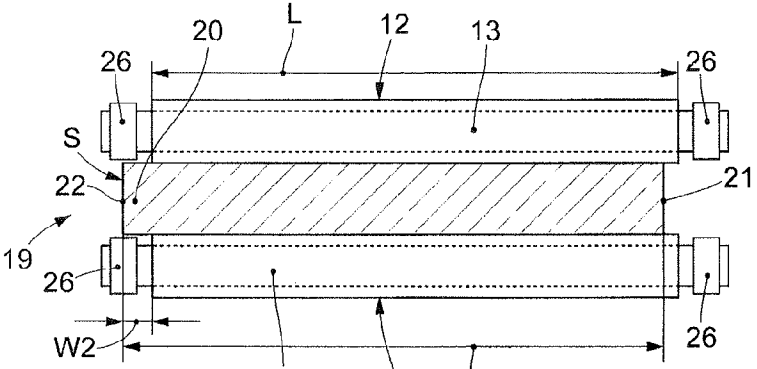
FIG. 3 is a section view along section line III-III of FIG. 2.
Figure 5:
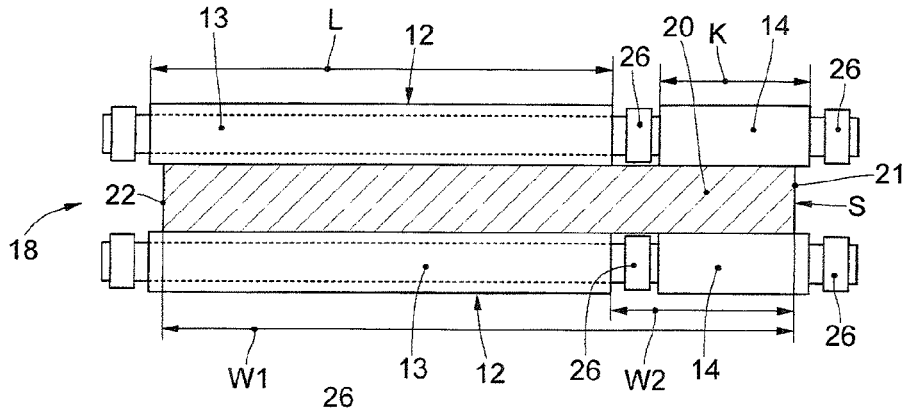
FIG. 5 is variant of FIG. 2.
Figure 6:
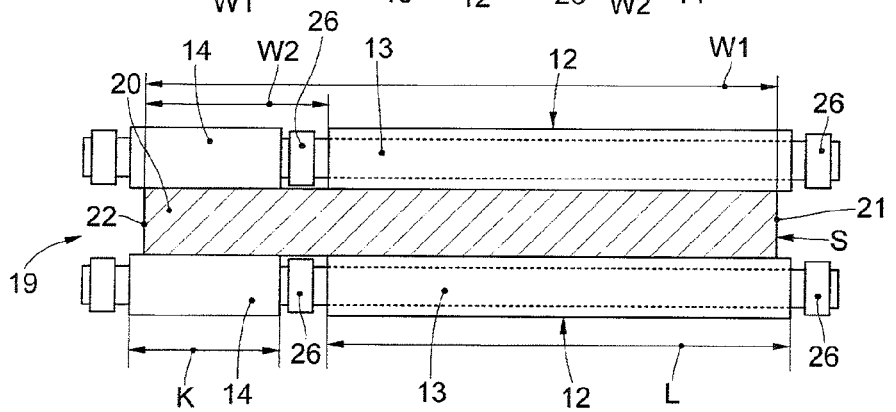
FIG. 6 is a variant of FIG. 3.
Figure 7:
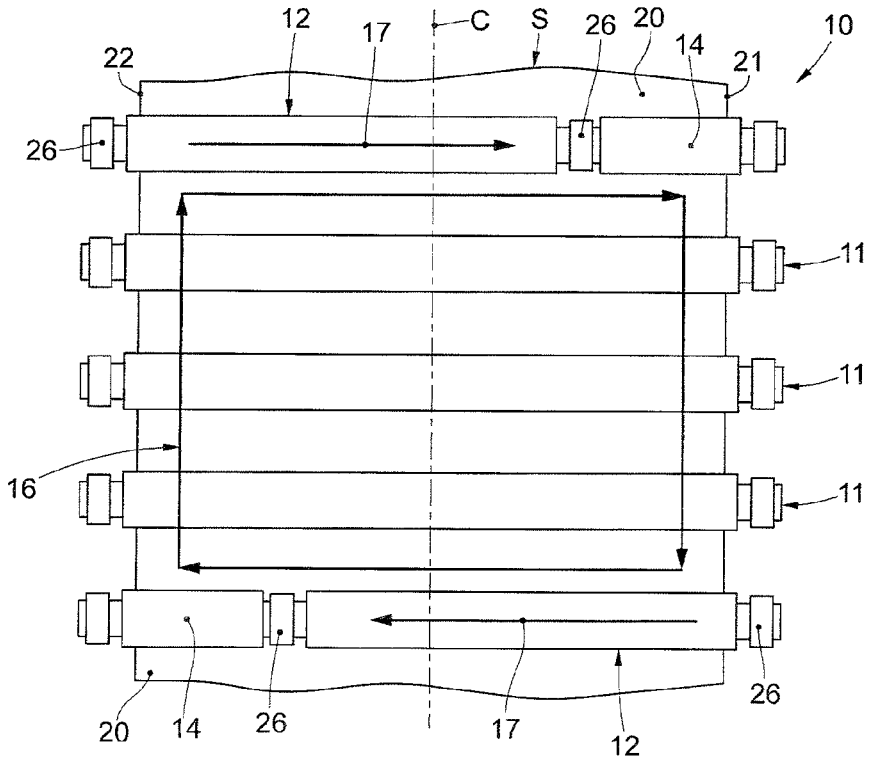
FIG. 7 is a lateral view of FIGS. 5 and 6.

This disposition of the electromagnetic rolls 12 allows to maximize and homogenize as much as possible the liquid steel recirculation loop 16, as shown in FIGS. 4 and 7.

In fact (FIG. 4), this particular disposition of the first electromagnetic roll 12 and the second electromagnetic roll 12 allows to obtain a distribution of the recirculation loops 16 uniformly distributed in the zone between the first electromagnetic roll 12 and the second electromagnetic roll 12.

In particular, to generate these recirculation loops 16, the electromagnetic force 17 generated in the first electromagnetic roll 12 is directed in a first direction, opposite to a second direction along which the electromagnetic force 17 generated in the second electromagnetic roll 12 is directed.

Preferably, the unsupported width W2 of the protruding portion 20 which protrudes outside the first electromagnetic roll 12 is equal to the unsupported width W2 of the protruding portion 20 which protrudes outside the second electromagnetic roll 12.

According to a possible solution of the invention, one of said electromagnetic rolls 12 is positioned directly below the mold 15.

According to another embodiment (FIGS. 5-8), if the unsupported width W2 of the slab S is too long, each of the electromagnetic rolls 12 is associated with a respective auxiliary containing roll 14, aligned to, and in axis with, the respective electromagnetic roll 12.

Thus, the electromagnetic rolls 12 mostly support the slab S, and the auxiliary containing rolls 14 support the remaining part of the slab S, namely the protruding portion 20.

The auxiliary containing rolls 14 have not an active electromagnetic inductor inside but have only a support function.

The auxiliary containing rolls 14 have a length K which can be equal to or greater than said unsupported width W2.

Preferably, it is provided to use the auxiliary containing rolls 14 when the ratio between the unsupported width W2 and the width W1 of the slab S is comprised between 10% and 40%.

According to a possible embodiment, the auxiliary containing rolls 14 have a length K, which is comprised between 10% and 40% of the length L of the respective electromagnetic roll 12.

According to a possible solution of the present invention (FIGS. 5-8), each electromagnetic roll 12, and the respective auxiliary containing roll 14 associated therewith, are supported by said support element 26. In particular, the support element 26 is configured to support one of the electromagnetic rolls 12 and the respective auxiliary containing roll 14 in axis, one after the other, and directly next to each other.

In accordance with a possible embodiment (FIGS. 7 and 8), the first electromagnetic roll 12 comprises a respective auxiliary containing roll 14 disposed aligned with the first electromagnetic roll 12, and the second electromagnetic roll 12 comprises a respective auxiliary containing roll 14 disposed aligned with the second electromagnetic roll 12.

The auxiliary containing roll 14 associated with the first electromagnetic roll 12 is located in an opposite position with respect to the auxiliary containing roll 14 associated with the second electromagnetic roll 12.

In other words, the auxiliary containing roll 14 associated with the first electromagnetic roll 12 is located on a first side with respect to the casting axis C, while the auxiliary containing roll 14 associated with the second electromagnetic roll 12 is located on a second side, opposite the first side, with respect to the casting axis C.

As can also be seen in FIG. 8, in this variant of the casting equipment 10 too, the electromagnetic force 17 generated in the first electromagnetic roll 12 is directed in a first direction, opposite a second direction along which the electromagnetic force 17 generated in the second electromagnetic roll 12 is directed.

Embodiments of the present invention are also directed to a casting equipment 10 comprising said mold 15 configured to cast a slab S, and said plurality of rolls 11, 12 disposed in pairs facing to each other, and along the casting axis C in order to define a passage for the cast slab S.

According to the present invention, the electromagnetic forces 17 generated by the travelling magnetic field are more homogeneous along the slab width W1 because the shortening of the electromagnetic rolls 12 compared to the slab width W1 smooth the electromagnetic edge effect while maintaining sufficient stirring effect.

It is clear that, although the present invention has been described with reference to some specific examples, a person of skill in the art shall certainly be able to achieve many other equivalent forms of the present method for contain a slab during continuous casting, having the characteristics as set forth in the claims and hence all coming within the scope of protection defined thereby.

The invention claimed is:

1. Continuous casting equipment, comprising:

a mold configured to cast a slab, and a plurality of rolls disposed in opposing pairs facing each other, the pairs spaced apart along a casting axis in order to define a passage between the pairs for the cast slab, wherein the plurality of rolls comprises electromagnetic rolls, the electromagnetic rolls provided internally with an electromagnetic stirrer configured to stir a liquid contained in the slab, and including containing rolls configured to exert only a containing action on said slab during continuous casting, wherein the electromagnetic rolls and therefore said passage are configured to have a length less than a width of the slab so that at least a portion of the slab axially adjacent to auxiliary containing rolls protrudes with respect to one end of said electromagnetic rolls, and wherein said containing rolls are configured to have a length substantially equal to said width of the slab; and wherein the plurality of rolls includes a first pair of electromagnetic rolls and a second pair of electromagnetic rolls, the first and second pairs of electromagnetic rolls spaced from one another along the casting axis;

wherein each of the electromagnetic rolls is associated with a respective non-electromagnetic auxiliary containing roll that is aligned with and coaxial with the respective electromagnetic roll, each of the electromagnetic stirrer rolls and their associated auxiliary containing rolls being in contact with the slab;

wherein the auxiliary containing rolls associated with the first pair of electromagnetic rolls are located on a first side with respect to the casting axis, and wherein the auxiliary containing rolls associated with the second pair of electromagnetic rolls are located on a second side, opposite the first side, with respect to the casting axis;

wherein a plurality of containing rolls are provided between the first and second pairs of the electromagnetic rolls, the plurality of containing rolls arranged to contain and support the slab;

wherein the auxiliary containing rolls each have a first length and the first and second pairs of electromagnetic rolls have a second length, and wherein the first length is 10% to 40% of the second length; and wherein the first pair of electromagnetic rolls generate a first force in a first direction, and the second pair of electromagnetic rolls generate a second force in a second direction opposite the first direction, the first and second directions being transverse to the casting axis thereby forming a recirculation loop between the first and second pairs of electromagnetic rolls.

* * * * *